United States Patent [19]

Kitchen

[11] 4,241,720

[45] Dec. 30, 1980

[54] PULSE COMBUSTION APPARATUS

[76] Inventor: John A. Kitchen, R.R. #3, Hastings, Canada, K0L 1Y0

[21] Appl. No.: 6,702

[22] Filed: Jan. 26, 1979

[51] Int. Cl.[3] ..... F24H 3/02

[52] U.S. Cl. ..... 126/110 C; 60/39.77

[58] Field of Search ..... 126/110 C, 350; 431/1, 431/157, 160, 168; 122/24; 60/39.77

[56] References Cited

U.S. PATENT DOCUMENTS

| | | | |
|---|---|---|---|
| 3,005,485 | 10/1961 | Salgo et al. | 431/1 |
| 3,192,986 | 7/1965 | Haag | 431/1 |
| 3,267,985 | 8/1966 | Kitchen | 431/1 |
| 3,606,867 | 9/1971 | Briffa | 122/24 |
| 3,853,453 | 12/1974 | Olsson | 431/1 |
| 3,954,380 | 5/1976 | Valaev et al. | 431/1 |
| 4,008,991 | 2/1977 | McAleer | 431/1 |

*Primary Examiner*—George T. Hall

*Attorney, Agent, or Firm*—Rogers, Bereskin & Parr

[57] ABSTRACT

A pulse combustion heater is described and includes a combustion chamber and at least one exhaust pipe forming a resonant system with the chamber. In one aspect, the heater has a three part housing, upper and lower parts of which are concrete castings and define respectively an air cushion chamber and an exhaust chamber of the heater. A center section forms part of a boiler sub-assembly which isolates the exhaust chamber from the air cushion chamber. In another aspect, a unitary gas cushion chamber sub-assembly is described.

12 Claims, 14 Drawing Figures

PULSE COMBUSTION APPARATUS

This invention relates to pulse combustion apparatus and to heaters of the pulse combustion type.

A pulse combustion apparatus conventionally includes a combustion chamber and an exhaust pipe which forms a resonant system with the combustion chamber. At each cycle of the apparatus, a fuel charge is admitted to the combustion chamber and is ignited. The charge expands into the exhaust pipe causing a partial vacuum transient in the combustion chamber which both assists in drawing in a fresh charge, and causes high temperature gas to bedrawn back into the combustion chamber from the exhaust pipe. The fresh fuel charge spontaneously ignites, establishing the next cycle and the apparatus is self-sustaining after initial ignition. In a heater of the pulse combustion type, a fluid to be heated is brought into heat exchange relationship with the exhaust pipe.

U.S. Pat. No. 3,267,985 discloses a pulse-combustion-type heater in which the combustion chamber has substantially the shape of two conical shells joined together at their major diameters along a common line of juncture. Five exhaust pipes are coupled to the combustion chamber for heating and are disposed in a chamber through which water is circulated. While this form of combustion chamber and exhaust system has been found to provide a very stable combustion cycle, the present invention is aimed at providing further improvements intended to enhance performance.

Reference is also made to co-pending United States patent application Ser. No. 960,975 filed Nov. 15, 1978 which discloses and claims improvements in pulse combustion apparatus.

According to one aspect of the present invention there is provided a pulse combustion heater which has a housing made up of three housing sections of tubular form coupled together in a vertically stacked arrangement. The sections comprise a top housing section defining an air cushion chamber, a center housing section defining a heat exchange chamber, and a bottom housing section defining an exhaust chamber. The top and bottom sections are in the form of concrete castings closed at their upper and lower ends respectively while the center section forms part of a boiler sub-assembly further comprising top and bottom boiler heads closing opposite ends of said center housing section. The heater also includes a combustion chamber disposed in said heat exchange chamber of the housing and having an inlet communicating with said air cushion chamber, and an outlet in the heat exchange chamber. The heater also includes means for admitting successive fuel charges to the combustion chamber through its inlet and ignition means operable to initiate combustion in said chamber. An exhaust pipe is provided and forms a resonant system with the combustion chamber. The exhaust pipe is disposed in the heat exchange chamber of the housing and communicates with the exterior thereof.

According to another aspect of the present invention there is provided a pulse combustion heater which includes a housing defining an air cushion chamber and a combustion chamber having an inlet and an outlet. A unitary gas cushion chamber sub-assembly is disposed in the air cushion chamber and includes a hollow gas cushion chamber adapted to be coupled to supply of combustible gas, a valve plate extending across and closing said fuel inlet of the combustion chamber and a plurality of fuel inlet tubes extending upwardly from the valve plate and supporting the gas cushion chamber above said plate. Each fuel inlet tube communicates at its lower end with a fuel inlet opening in the valve plate and each such opening has associated therewith a plurality of air inlet openings communicating with said air cushion chamber. The subassembly also includes a plurality of one-way valves disposed in the combustion chamber inlet and each including a valve member responsive to pressure in said combustion chamber and movable to close said openings when combustion pressures exist in the combustion chamber, and to open said openings during a vacuum transient for admitting fuel.

In order that the invention may be more clearly understood, reference will now be made to the accompanying drawings which illustrate a number of preferred embodiments of the invention by way of example, and in which.

Figure 1:
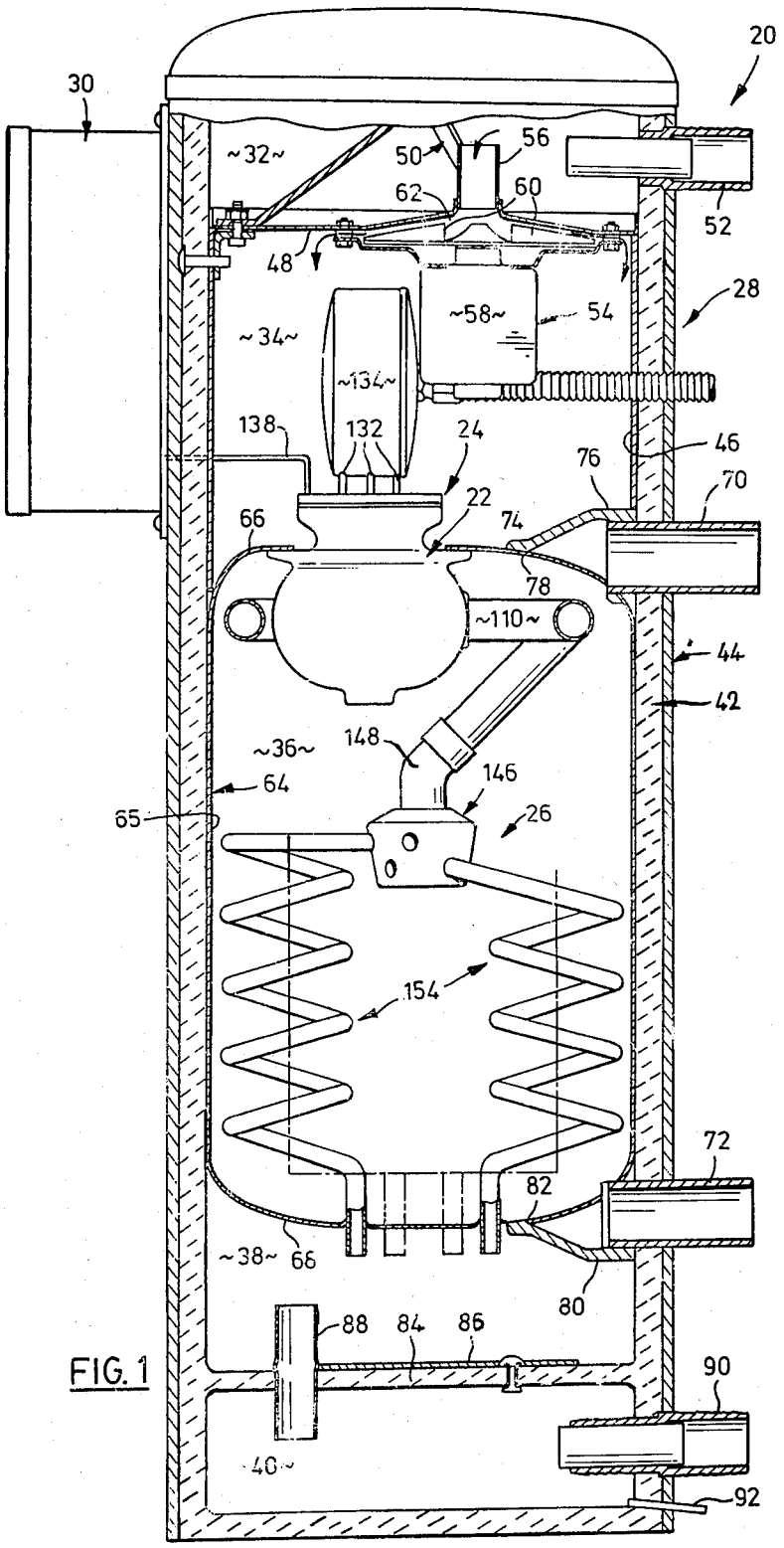
FIG. 1 is a vertical sectional view through a pulse combustion heater according to the invention.

Referring first to FIG. 1, a pulse combustion heater is generally indicated at 20 and includes a combustion chamber 22, valve means 24 at the top of the chamber for admitting fuel charges thereto, and an exhaust system 26. The components of the apparatus are disposed within a housing 28 which is designed to be self-standing on a suitable support surface. Reference numeral 30 indicates a control box which is disposed at one side of the housing and which houses suitable control equipment including an ignition transformer connected by a high tension lead (not shown) to a spark plug in the combustion chamber. The spark plug is used for starting only.

Housing 28 is divided internally as will be described to define, from top to bottom, an air inlet chamber 32, an air cushion chamber 34, a heat exchange chamber 36, a muffler chamber 38 and an exhaust chamber 40. The housing is defined by inner and outer casings denoted 42 and 44 respectively. The inner casing is made of high strength concrete, while the outer casing is made of steel. At the position of the air cushion chamber 34, the inner casing is fitted with a liner 46 of galvanized steel. The top of chamber 34 is defined by a plate 48 which separates the air cushion chamber 34 from the air inlet chamber 32. Supporting structure above plate 48 is generally indicated at 50 but will not be described in detail. Also, it should be noted that suitable sound insulating material is incorporated in the top of the housing and in the inner casing, but has not been shown, again because it forms no part of the invention.

Air inlet chamber 32 communicates with the exterior of the housing by way of an air inlet 52 which extends through the inner and outer casing. This allows ambient air or air from a supply pipe to be drawn into the housing for combustion as required. A fan unit generally denoted 54 is suspended below plate 48 and has an inlet 56 within chamber 32. The fan unit includes an electric motor 58 driving fan blades 60 arranged within a fan chamber 62 which discharges into the air cushion chamber 34. This chamber provides a reservoir of combustion air. Air is drawn from chamber 34 into the combustion chamber 22 as required under the control of the valve means generally indicated at 24. Fan unit 54 is used only for starting; after ignition, the combustion process is self-aspirating.

Heat exchange chamber 36 is defined by a liner assembly generally denoted 64, which, in effect, forms a boiler inside housing 28. Thus, it will be seen that the liner assembly includes a cylindrical portion 65 and top and bottom closures or "heads" 66 and 68 respectively at opposite ends of the heat exchange chamber and that the chamber is provided with an inlet 70 and an outlet 72 which extend through housing 28. Each of these components is in the form of a tubular sleeve which passes through the housing 28 and communicates with an associated pipe connection which mates with a corresponding opening in the relevant closure member of liner assembly 64. In FIG. 1, the pipe connection associated with inlet 70 is denoted 76 and the associated opening in the top closure 66 is indicated at 78. The corresponding pipe connection for outlet 72 is denoted 80 and the corresponding opening is indicated at 82. The inlet and outlets are coupled to external equipment (not shown) for circulating water through a heat exchange chamber 36 for heating. The combustion chamber 22 is mounted in an opening 74 in the top closure 66 of the liner assembly 64 so that water entering the heat exchange chamber 36 through inlet 70 will flow around the combustion chamber for transfer of heat from the chamber to the water. Similarly, as the water flows down in chamber 36 towards outlet 72, it will flow around the exhaust system 26 and receive heat therefrom.

Muffler chamber 38 is defined between the lower closure member 68 of liner assembly 64 and a plate 84 which extends transversely inside housing 28 at a spacing below the bottom closure member 68. The exhaust system 26 discharges generally vertically downwards into chamber 38 as will be described and a heat shield 86 is attached to the upper surfaces of plate 84. A muffler tube 88 extends generally vertically through plate 84 at a position spaced laterally from the position at which the exhaust system discharges into chamber 38. Thus, exhaust gases entering chamber 38 from the exhaust system 26 will pass into exhaust chamber 40 by way of muffler pipe 88. Chamber 40 has an exhaust outlet pipe 90 through which the exhaust gases leave housing 28 and from which the gases may be vented to atmosphere or otherwise disposed of as appropriate. A narrow condensate drain tube 92 is provided at the bottom of chamber 40 and is inclined downwardly so that any liquid which may collect in the chamber will drain to the outside.

Figure 2:
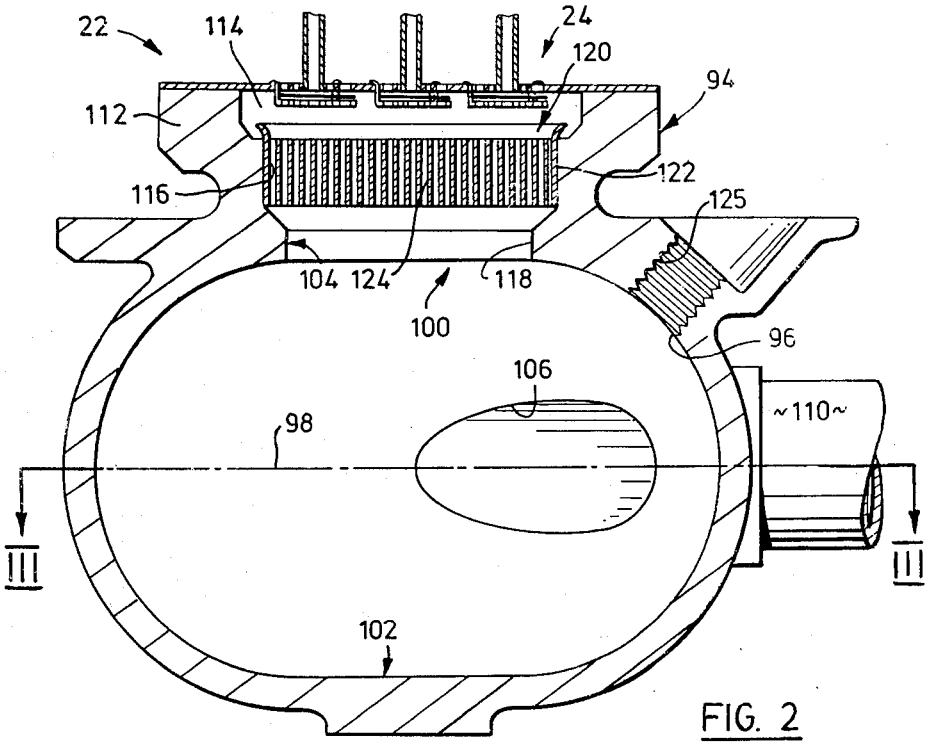
FIG. 2 is a vertical sectional view through the combustion chamber of the apparatus shown in FIG. 1.
Figure 3:
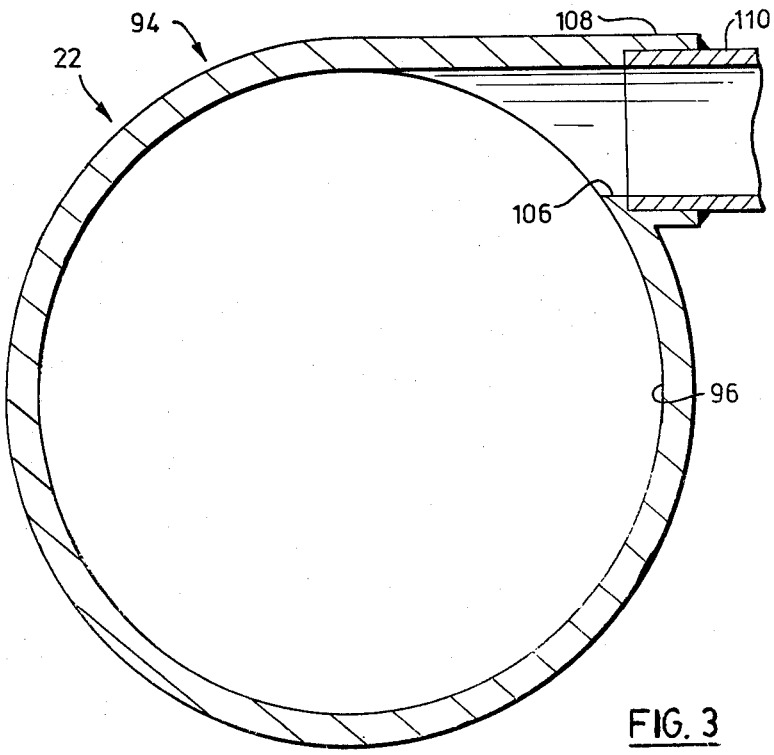
FIG. 3 is a transverse sectional view on line III—III of FIG. 2.

Reference will now be made to FIGS. 2 and 3 in describing the combustion chamber 22 of the apparatus. Combustion chamber 22 is in the form of a one-piece bronze casting, denoted 94, at the top of which the valve means 24 is located. The combustion chamber has an internal cavity 96 which is generally of flattened spherical shape. Thus, cavity 96 extends about a median plane 98, on which plane section III—III is taken. The cavity is of a shape which is circular in said plane, and which curves generally inwardly from both sides of said plane around its entire periphery towards first and second ends 100 and 102 of said cavity. Casting 94 defines an inlet 104 at the first end of the cavity through which successive fuel charges can enter the combustion chamber cavity, while the second end 102 of the cavity is closed and generally flat. An exhaust outlet 106 is provided in the wall of the combustion chamber and is located in median plane 98. An integral sleeve 108 extends from the combustion chamber generally tangentially with respect to cavity 96 and a pipe 110 of the exhaust system (see later) is coupled to the sleeve.

The combustion chamber inlet 104 is in the form of a passageway which extends through casting 94 from a top flange 112 to cavity 96 and includes three portions 114, 116 and 118 of progressively reducing diameter considered in the direction of fuel charge flow. As will be seen from FIG. 4, the flange 112 and passageway portions 114, 116 and 118 are of circular shape in plan. The center passageway portion 116 receives a flame trap 120 for preventing blow-back of burning gases through the combustion chamber inlet. Flame trap 120 is in the form of an outer tubular retainer 122 and a core 124 formed of a spiral of corrugated stainless steel strip; the corrugations leave openings between the turns of the spiral through which fuel charges can flow. A screw threaded opening 125 adjacent inlet 104 receives a spark plug (not shown) for initiating the combustion process.

Figures 4, 5:
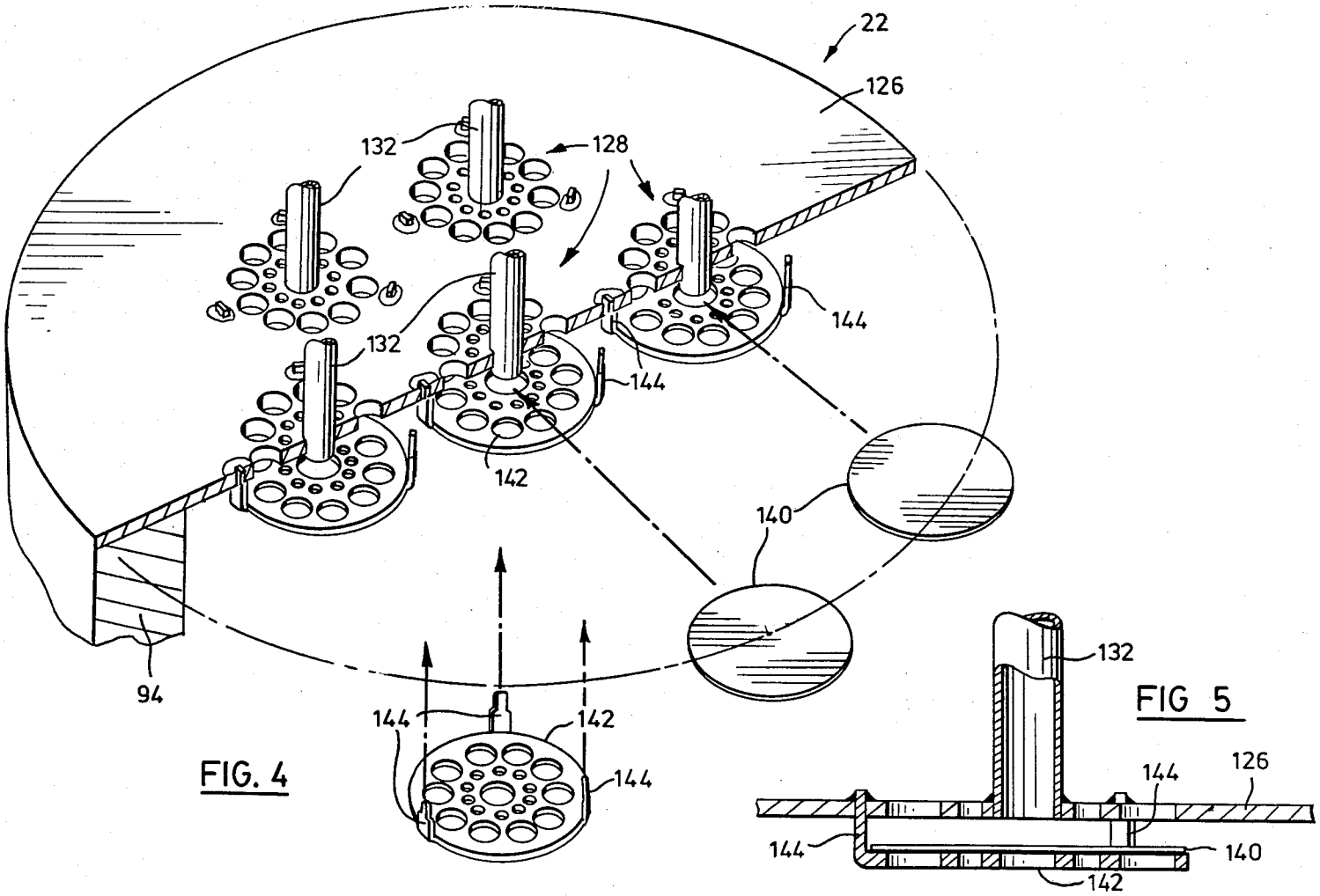
FIG. 4 is a perspective view, partly in section and partly exploded, showing the valve means of the combustion chamber of FIGS. 2 and 3.
FIG. 5 is a vertical sectional view of part of FIG. 4.

Referring now more particularly to FIGS. 4 and 5, valve means 24 includes a valve plate 126 mounted on the top surface of the flange 112 of casting 94. Plate 126 is provided with a number of sets of openings for admitting fuel charges of air and natural gas to the combustion chamber. In FIG. 4, the sets of openings are denoted by reference numeral 128 and it will be seen that five such sets are visible; in fact, plate 126 is provided with seven sets of valve openings although two of the sets do not appear in FIG. 4. Each set of openings includes a central opening 130 for admitting natural gas and a plurality of openings 131 distributed around opening 130 and through which air is admitted to the combustion chamber. Each central opening 130 is fitted with an inlet tube 132 which extends vertically upwardly from plate 126. Referring back to FIG. 1 the tubes 132 communicate with a gas cushion chamber defined by a casing 134 which in this case is made of sheet brass. The gas cushion chamber is of generally cylindrical shape with domed ends (although the particular shape is not critical) and is fitted at one end with a corrugated fuel inlet tube 136 which extends through housing 28 and communicates outside the housing with a source of natural gas (not shown). Thus, the gas cushion chamber 134 will provide the combustion chamber with what is, in effect, a reservoir of gas at source pressure for admission to the chamber through the fuel inlet tubes 132. Air cushion chamber 34 provides a similar reservoir of combustion air. A pressure sensing tube 138 is shown adjacent the air cushion chamber 134 in FIG. 1 and can be connected to switch in control box 30 for indicating when combustion has been established. Means (not shown) may also be provided for maintaining a substantially constant air/fuel ratio as described in my U.S. Pat. No. 3,267,985.

Referring back to FIGS. 4 and 5, the sets 128 of openings in plate 126 are controlled by individual valves, each of which includes a light and freely movable valve disc such as those shown in exploded positions at 140 in FIG. 4. In this particular embodiment, the discs are made of Dacron (T.M.) fabric coated with polychlorotrifluoroethylene sold under the trade mark Kel-F by M. W. Kellog Co. Each disc 140 is retained below the associated set of openings by a support plate 142 suspended from valve plate 126. Each support plate 142 is of circular shape and is formed with a set of openings corresponding generally to the openings in plate 126. Three integral lugs 144 project upwardly from plate 142 for suspending the plate. The lugs extend through opening in plate 126 and are bent over and sealed by silver brazing as can best be seen in FIG. 5. Thus, it will be appreciated that each valve disc 140 is supported by the associated plate 142 and is trapped against lateral movement by lugs 144. The openings in plate 142 permit pressure waves from the combustion chamber to force the valve disc 140 upwardly to close off the associated openings in valve plate 126. When the pressure decreases, the discs will move down and admit fuel to the combustion chamber.

Figure 6:
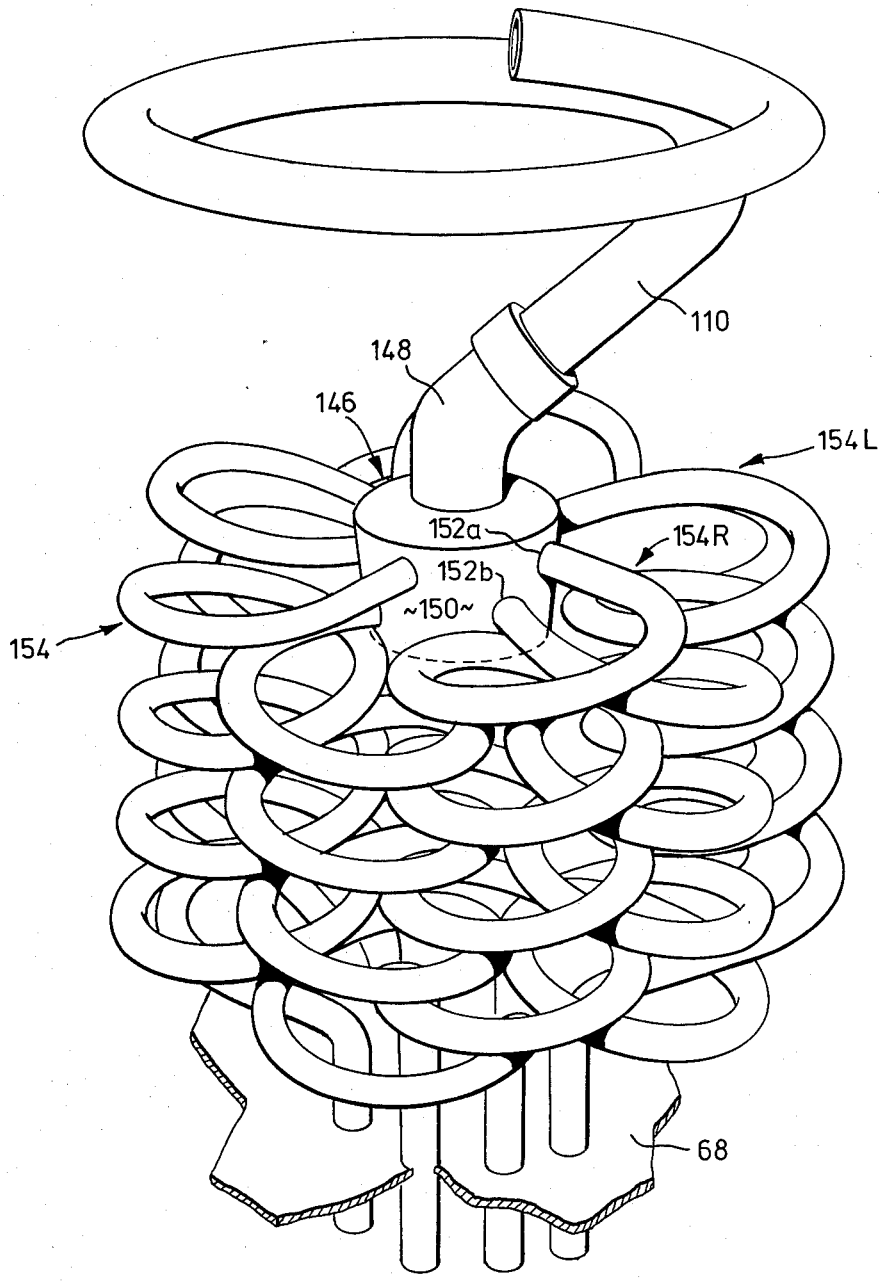
FIG. 6 is a perspective view of the exhaust system of the apparatus of FIG. 1.
Figure 7:
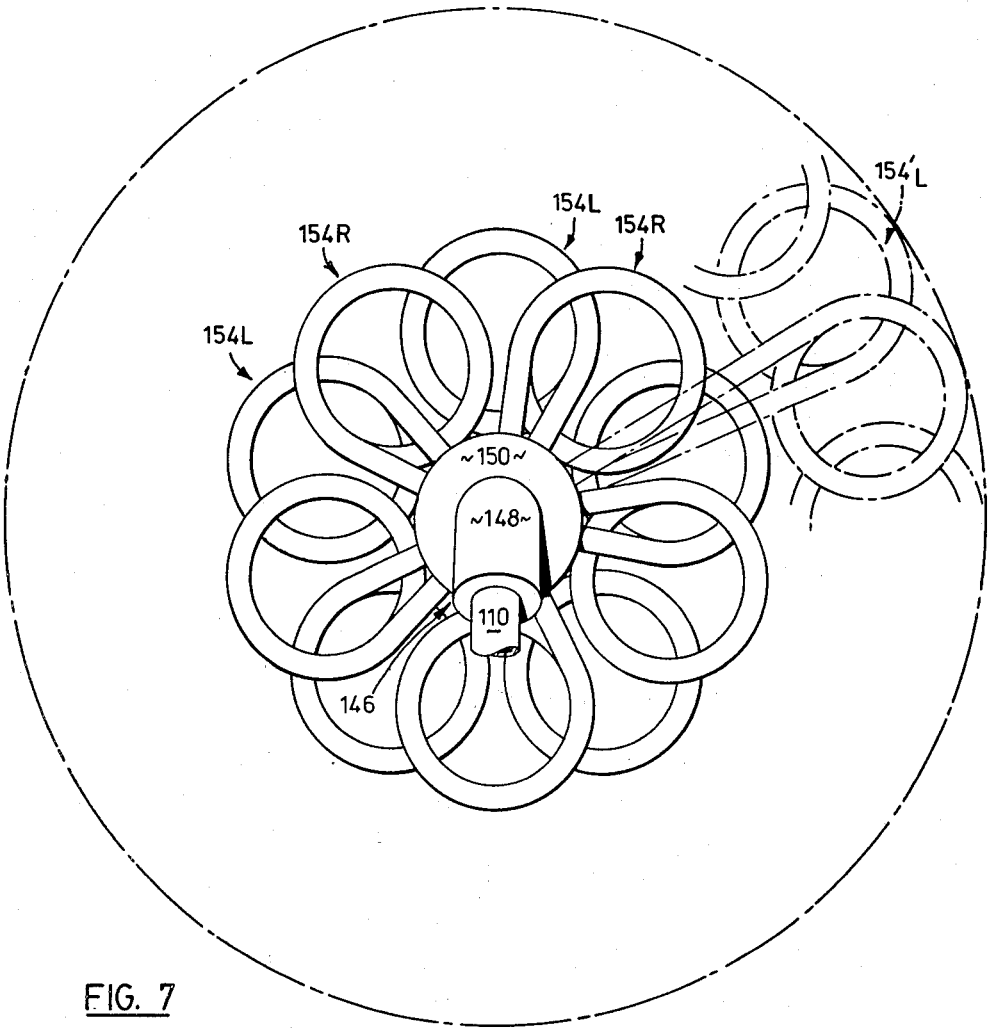
FIG. 7 is a plan view corresponding to FIG. 6.

FIGS. 6 and 7 show the exhaust system of the heater and will now be more particularly described. The system includes a single primary exhaust pipe 110 part of which is visible in FIGS. 3 and 4. This primary exhaust pipe has an inlet end coupled to the combustion chamber so as to extend outwardly from the chamber tangentially with respect to its circular configuration. Pipe 110 is of relatively substantial length (see later) and is shaped to define a generally circular loop portion which extends around the combustion chamber (see FIG. 1), and an end portion which is bent downwardly and connected to a manifold 146. Manifold 146 has a single central inlet to which the primary exhaust pipe 110 is coupled. In this embodiment the inlet is defined by a sleeve 148 which projects upwardly from a main body portion 150 of the manifold and which is angled to correspond with the inclination of outlet end portion of the primary exhaust pipe 110. Pipe 110 is received in and welded to sleeve 148. The body portion 150 of the manifold 146 is generally cylindrical in shape and is formed with a plurality of outlets in the form of openings in its outer surface which communicate with the single central inlet. The outlet openings are arranged in pairs in equally spaced relationship around the body portion 150 of manifold 146 with the outlets in each pair spaced vertically from one another and staggered laterally to a slight extent as can clearly be seen in FIG. 6 in the case of one pair of outlet openings (denoted **152*a* and 152*b*). A plurality of heat exchange coils generally denoted 154 are provided for connecting manifold 146 with the muffler chamber 38 (FIG. 1). Each coil is in the form of a hollow tube shaped to define a helix of substantially constant diameter extending about a longitudinal axis and having an inlet coupled to one of said manifold outlets, and an outlet which communicates with the muffler chamber 38 of the heater. The heat exchange coils are arranged in pairs around manifold 146 and each pair comprises one left hand wound coil and one right hand wound coil of identical shape and size. Referring to FIG. 6, reference numeral 154L denotes the left hand coil of a pair while 154R denotes the corresponding right hand coil. The corresponding pair of coils are similarly designated in FIG. 7. Five such pairs of coils are provided around manifold 146**.

It will be apparent from FIGS. 6 and 7 that, by virtue of the vertically staggered arrangement of the manifold outlets **152*a* and 152*b*** the coils in each pair can "mesh" with or be interleaved with one another so that the turns of one coil fit between the turns of the corresponding coil. Similarly, adjacent coils of different pairs can be meshed or interleaved with one another. This provides for a very compact heat exchange unit having large capacity. A further advantage of this arrangement is that it can be readily fabricated using conventional coil winding equipment and with minimum bending of the pipes. Thus, successive coiled sections can be taken directly from a coil winding machine and fitted into the manifold without the need for special fabrication techniques.

A still further advantage of this heat exchanger construction is that heat exchangers having even more coils can be readily fabricated by enlarging the manifold and adding coils around the periphery of the existing coils are indicated in chain dotted line at 154' in FIG. 7. These additional coils may be arranged in pairs of left and right hand coils interleaved with one another in the same fashion as the center coils. The inlet ends of the coils would be extended inwardly as shown in FIG. 7 and connected into the larger manifold in a second row of staggered manifold outlets above the outlets shown in FIG. 6.

A still further advantage of the heat exchange structure shown in the drawings derives from the fact that curved pipes are used. Thus, in a heat exchanger having straight pipes, the boundary layer effect produces, in effect, an insulating layer of stagnant air which tends to inhibit heat transfer from the pipes and reduces the efficiency of the heat exchanger. In the present application in which high velocity gas flows are encountered, the use of curved pipes minimized the boundary layer effect and increases the efficiency of the heat exchanger compared with a conventional unit having straight pipes. Curved pipes also have the advantage that they are capable of accommodating thermal expansion and contraction without the need for special precautions in the construction of the heat exchanger.

Referring back to FIG. 6, it will be seen that the outlet end portion of each of the heat exchange tubes is shaped to define an axially parallel end portion **154*a* which extends through the bottom boiler head 68 of the heat exchange liner assembly 64 (see FIG. 1**).

The operation of the heater will now be described initially with reference to FIG. 1 of the drawings. As indicated previously, the apparatus is designed to be self-sustaining after initial starting. Thus, a supply of fuel and air is delivered to the combustion chamber from the gas cushion chamber 134 and from the fan 54 respectively and is ignited by the spark plug in the combustion chamber. The pressure rise which occurs in the chamber upon ignition causes the valve discs 140 (FIG. 4) to be propelled upwardly and close off the air and gas inlet openings in the valve plate 126. The combustion gases expand and enter the primary exhaust pipe 110, causing a vacuum transient in the combustion chamber itself. This allows the valve discs 140 to move downwardly under the effect of the pressurized air and fuel acting on the discs from above so that a fresh fuel charge enters the combustion chamber. The vacuum transient also has the effect of causing combustion gases in the exhaust system to return to the combustion chamber.

Figure 8:
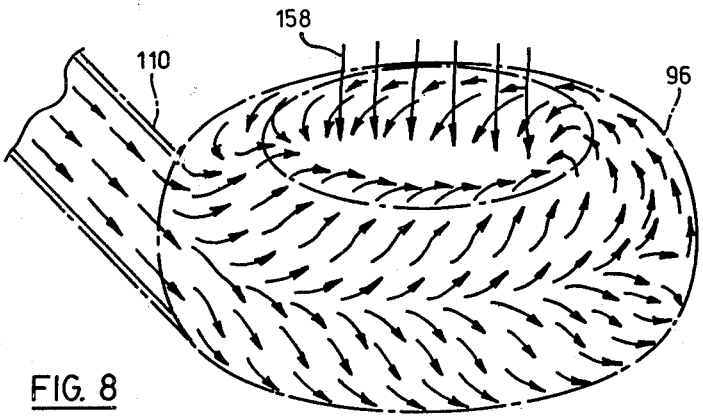
FIG. 8 is a diagrammatic illustration of the gas flow pattern in the combustion chamber of the apparatus shown in FIG. 1.

The combustion chamber has been designed so that this returning pressure wave of combustion gases entering the combustion chamber is caused to flow in a double toroidal flow pattern as indicated diagrammatically in FIG. 8. In that view, the wall of the combustion chamber cavity is indicated by a chain dotted outline denoted 96 and a tangential portion of the primary exhaust pipe is indicated at 110. By virtue of the tangential arrangement of this pipe and its position on the median plane of the combustion chamber cavity, the returning gases meet the combustion chamber wall generally in the region of the median plane. Since the wall curves inwardly at both sides of that plane, the gases are caused to flow inwardly both above and below the median plane in addition to being caused to follow the curvature of the wall around the circumference of the cavity. This generates the double toroidal flow pattern. Next the succeeding fuel charge enters the combustion chamber from inlet 104 generally centrally of the chamber and thus enters the center of the toroidal flow pattern of the combustion gases. In FIG. 8, the flow path of the fuel charge is indicated generally at 158.

It has been found that the flame in the combustion chamber is not extinguished at any time during the cycle of the apparatus. During the low pressure part of the cycle (that is during the vacuum transient—generally about one third to one half of the cycle time depending on cycle strength) the gases in the combustion chamber are relatively stagnant and a number of flame fronts persist throughout the mixture. This low pressure draws the next fuel charge into the center of the combustion chamber with very little turbulance. The combustion gases returning to the combustion chamber through the primary exhaust pipe 110 are delayed due to the length of the pipe, but enter the combustion chamber at a very high velocity. These gases may be well below ignition temperature (since the exhaust system is water cooled); however, while the temperature will have an effect on the operating frequency of the apparatus, it has not been found to cause instability in the combustion cycle. In any event, as these returning gases enter the combustion chamber the residual gases containing the flame fronts are rapidly mixed with the fresh charge due to the double toroidal flow pattern described above. There is a rapid increase of temperature and pressure and gases again start to flow out of the combustion chamber through the exhaust pipe. Complete ignition and pressure rise has been found to occur within approximately one tenth of the cycle time. This double toroidal turbulance pattern in the combustion chamber is very consistent with virtually no stray tails of flame which would cause per-ingnition of the charge and produce a pressure rise at the wrong time in the cycle. Thus, it will be understood that ignition of the incoming charge should be kept to a minimum until the high velocity combustion gases return to the combustion chamber. Ignition will then take place at a rate which is related to the gas velocity and the turbulance pattern.

An additional advantage derived from the combustion chamber design shown in the drawings is that the outside dimension of the combustion chamber can be minimized for a given volume, substantially reducing the space required to accommodate the combustion chamber. Another advantage is that the ratio of surface area to volume of the combustion chamber is at a minimum so as to reduce any quenching effect on the burning gases in the combustion chamber due to the presence of cooling water in the heat exchange chamber 36.

It has also been found that the design of the exhaust system has a significant impact on the operation of the apparatus. Thus, it will be noted that the system includes a primary exhaust pipe (110) which is of relatively large diameter and is of a significant length. These characteristics are selected with the aim of insuring that combustion is completed in the primary exhaust pipe 110 and is not carried through into the heat exchange portion of the exhaust system. Thus, it has been found that, even with the improved combustion chamber design provided by the invention, some combustion occurs in the exhaust system. The high velocity of the gases entering the exhaust system results in a high rate of heat transfer to the surrounding water which, with the temperature drop which occurs due to expansion, results in some carbon monoxide in the gases. By providing an exhaust system in which substantially all of the combustion takes place upstream from the heat exchange coils this cooling effect on the gases and hence the high carbon monoxide content of the exhaust is minimized, while at the same time achieving efficient heat exchange to the water in the heat exchange chamber 36 through the medium of the heat exchange coils 154. A thin layer of an insulating material may even be applied to the primary exhaust pipe 110 in an effort to maintain the temperature of the combustion gases in the pipe and thereby to reduce the carbon monoxide content of the gases. In practice, it has been found that an increase in surface temperature of even 100° F. will make a significant difference to the percentage of carbon monoxide in the exhaust.

A further expedient which may be adopted in the interest of minimizing carbon monoxide emission is to provide a restricter or nozzle (not shown) in the exhaust pipe at its connection to the combustion chamber. Thus, since the combustion cycle is dependent upon the high velocity of the gases returning to the combustion chamber during the low pressure part of the cycle for providing fast ignition, a restricter or nozzle provides for a larger volume for secondary combustion and at the same time gives the returning pressure wave a high velocity as it enters the combustion chamber (for rapid ignition). In practice, it has been found that, for optimum results, the inside diameter of the combustion chamber cavity in the median plane should be equal to or less than three times its height. Also, it has been found that the inside diameter of the primary exhaust pipe should be at least about $\frac{3}{4}$ of an inch and that the pipe should be not less than ten inches in length.

It has been found that a single pipe is suitable for an apparatus having a relatively small heat output rating and that, for a larger apparatus the number of pipes may be multiplied in proportion to the increase in output rating. For example, in practical tests, an apparatus rated at 100,000 B.t.u. per hour required a single pipe of 1" internal diameter and a 400,000 B.t.u. apparatus required four such pipes. In a multiple pipe installation they will be equally spaced around the combustion chamber and will each be disposed tangentially thereto. A more complex manifold (as manifold 146) is obviously required in such cases.

Figure 9:
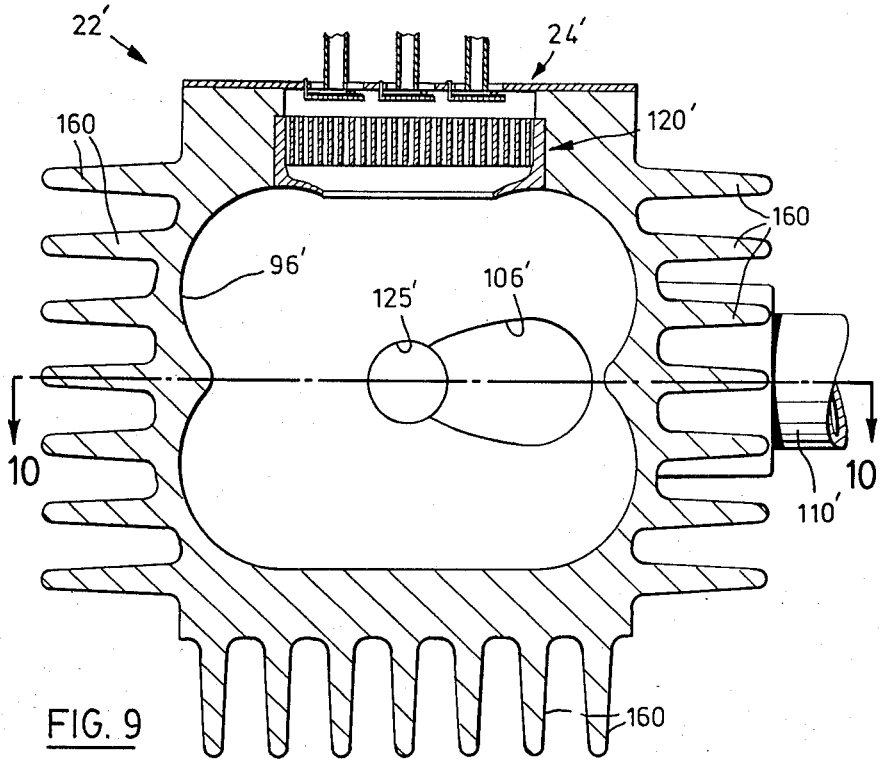
FIGS. 9 and 10 are views corresponding to FIGS. 2 and 3 respectively showing modified combustion chamber.
Figure 10:
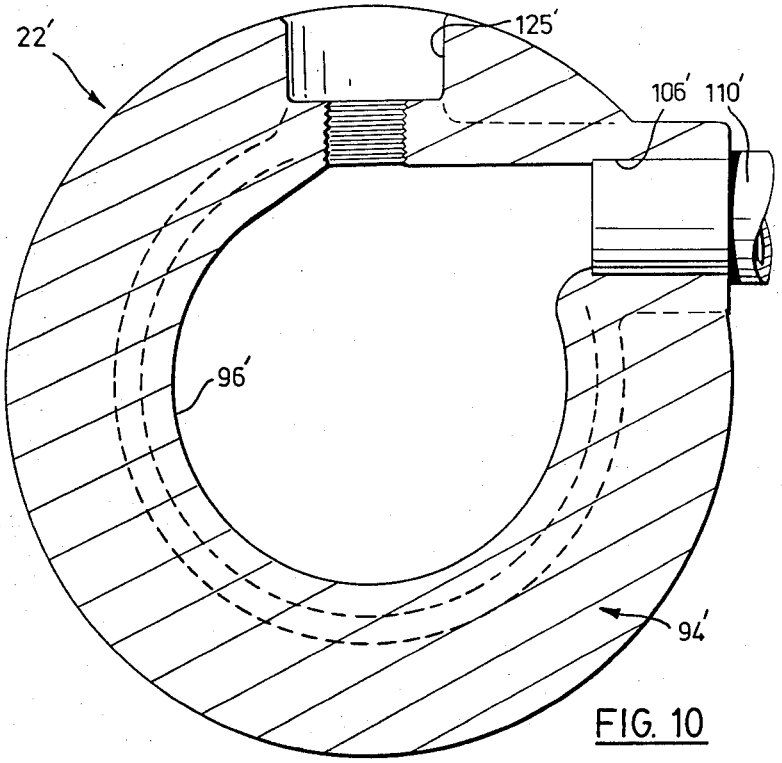

Reference will finally be made to FIGS. 9 and 10 which illustrate a modified form of combustion chamber which may be advantageous in certain applications. Primed reference numerals have been used in FIGS. 9 and 10 to illustrate parts which correspond with FIGS. 2 and 3. The combustion chamber shown in FIGS. 9 and 10 has, in fact, been designed primarily for use in a pulse combustion apparatus in which the combustion chamber is air cooled; that is, where the apparatus is either an air cooled engine or is being used for heating air. For this reason, the combustion chamber is shown as having external fins denoted 160 for promoting heat transfer from the combustion chamber to the surrounding air. However, it should be noted that this is only one example of an application of this form of combustion chamber and that, in other applications, the fins might well be omitted.

The primary difference between the combustion chamber of FIGS. 9 and 10 and that shown in the previous views is that the inner wall of the combustion chamber is contoured to define an inwardly protuberant surface portion around the inner periphery of the combustion chamber in its median plane 98'. The effect of this protuberant portion is to positively separate the returning combustion gases which enter the chamber cavity into two distinct flow paths. Thus, the flow pattern in the chamber of FIGS. 9 and 10 is essentially the same as that which occurs in the case of the combustion chamber of FIGS. 2 and 3, but is somewhat more discrete. This form of flow pattern may be desirable in some situations although it should be emphasized that, in practice, it has not generally been found essential to provide for physical separation of the returning gases in this fashion in order to achieve satisfactory combustion.

Reference will now be made to FIGS. 11 to 14 in describing a pulse combustion heater according to a further embodiment of the invention.

In principle, the heater shown in these views is similar to the heater described above with reference to FIGS. 1 to 7. Thus, the heater includes a housing, generally indicated at 200, which defines internally, an air inlet chamber 202, an air cushion chamber 204, a heat exchange chamber 206, a muffler chamber 208 and an exhaust chamber 210. A fan unit 212 is positioned between the air inlet chamber 202 and the air cushion chamber 204 although the unit is shown in a partly exploded position in FIG. 11. A gas cushion chamber 214 is disposed within the air cushion chamber 204 and a gas supply pipe 216 is coupled to chamber 214. The chamber forms part of a sub-assembly which is illustrated in detail in FIG. 13, and which includes valve means of the same form as that described previously in connection with FIG. 4.

A combustion chamber 218 is disposed in the heat exchange chamber 206 and supports the gas cushion chamber sub-assembly as will be described. An exhaust system 220 is associated with combustion chamber 218 and discharges into the muffler chamber 208. The combustion chamber and exhaust system are of the same form as the combustion chamber 22 and exhaust system 26 described with reference to the previous views.

A primary difference between the heater being described and the heater of FIGS. 1 to 7 resides in the construction of the housing 200. As in the first embodiment, housing 200 includes inner and outer casings, denoted 222 and 224 respectively. The outer casing 224 is in the form of a one piece steel shell of cylindrical form and the inner casing 222, while also of generally cylindrical form, is an assembly of three generally cylindrical casing sections, namely an air cushion chamber section 226, a boiler section 228, and an exhaust chamber section 230. The sections are bolted together as will be described to form the inner casing 222 and are designed to provide a gas-tight assembly in which there can be no leakage of gases between the exhaust or muffler chambers of the heater and the air cushion chamber. This form of inner casing also has the advantage that the heater can be manufactured as three sub-assemblies (an air cushion chamber sub-assembly, a boiler sub-assembly, and an exhaust chamber sub-assembly) which can be easily bolted together in assembling the heater.

Figure 11:
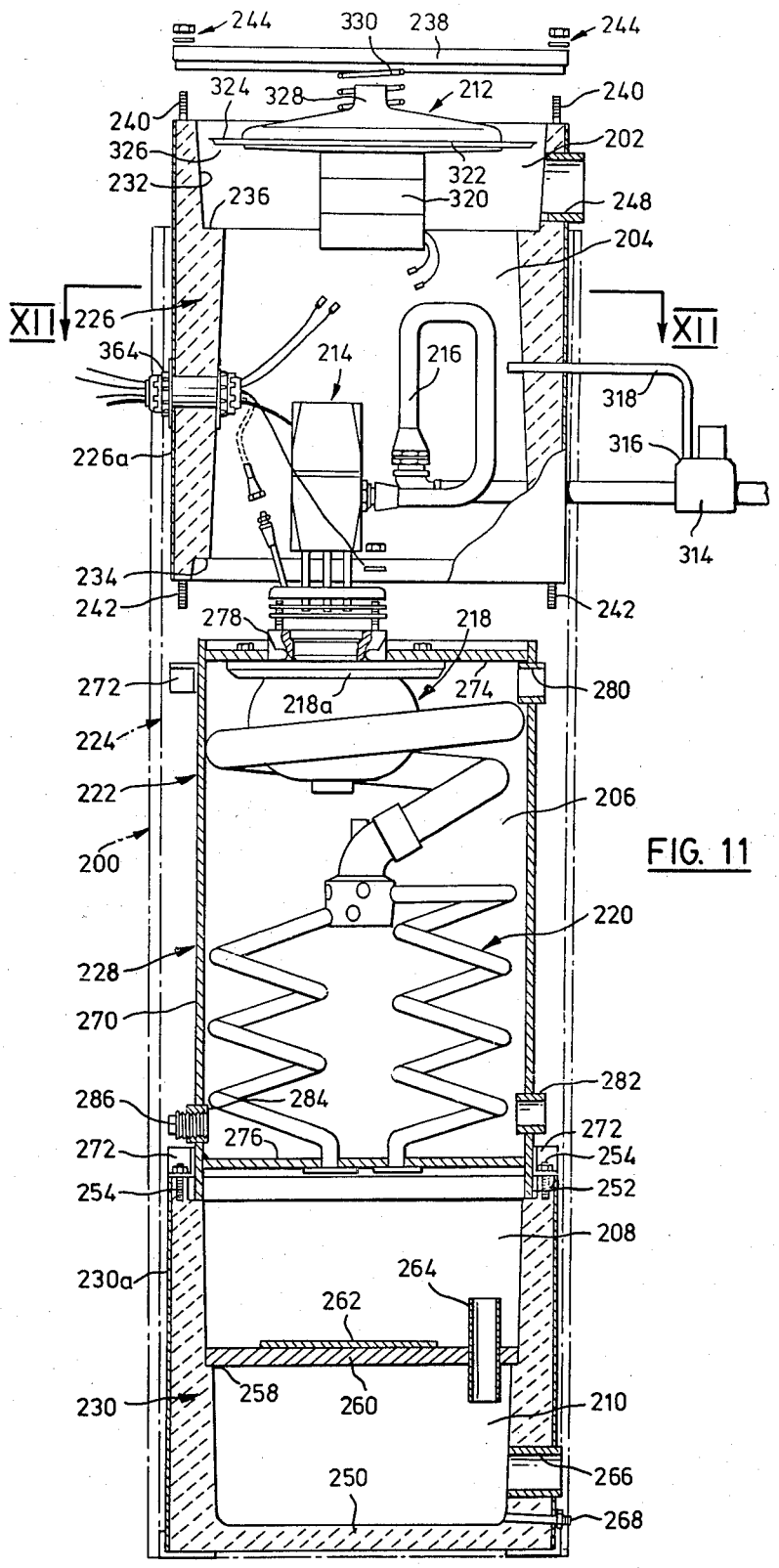
FIG. 11 is a vertical sectional view partly exploded, of a pulse combustion heater according to a further embodiment of the invention.
Figure 12:
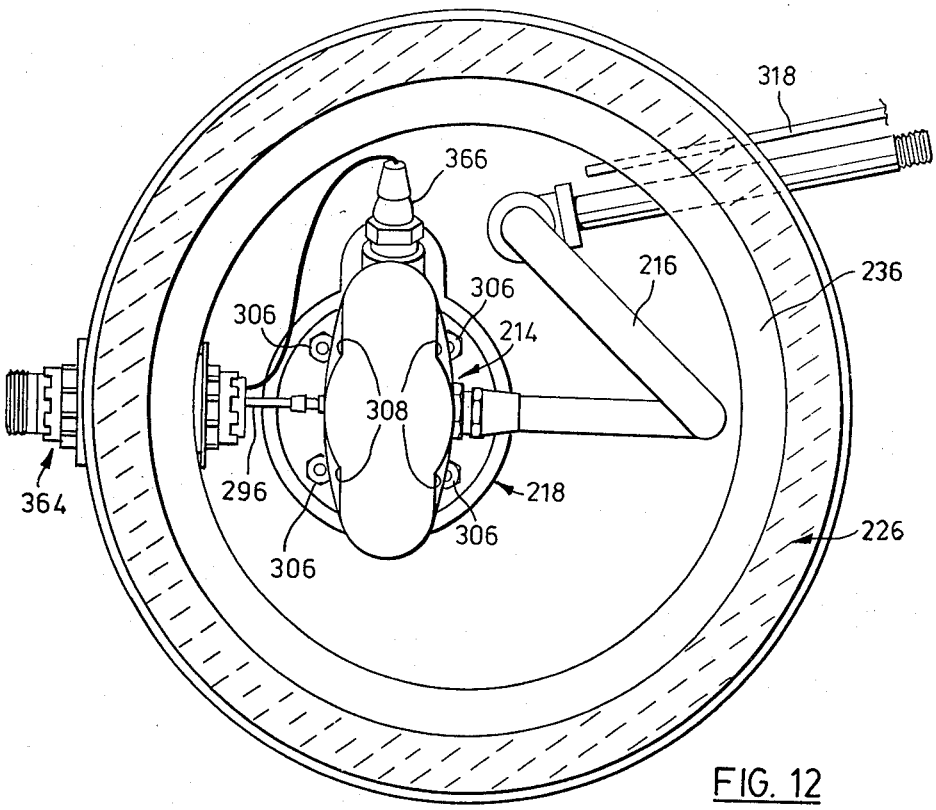
FIG. 12 is a transverse sectional view on line XII—XII of FIG. 11.

The air cushion chamber section 226 and exhaust chamber section 230 of the inner casing 222 are cast in concrete. The castings may be manufactured by any appropriate concrete casting technique, e.g. by rotational moulding. In this particular embodiment, the sections are designed to be made by a technique in which a steel shell is employed for forming the outer surface of each section and remains associated with the concrete casting after the casting operation has been completed. Thus, as shown in FIG. 11, steel shells **226*a* and 230*a* remain around the respective castings 226 and 230 of the inner casing. The casting which makes up the air cushion chamber section 226 is of generally cylindrical shape but is formed within its ends with upper and lower recesses 232 and 234 of annular form. The space between the recesses defines the air cushion chamber 204 of the apparatus. Recess 232 is of significant depth compared with recess 234 and is dimensioned to define the air inlet chamber 202. Recess 232 has an annular face 236 which is disposed normal to the longitudinal axis of section 226 and which forms a support for the fan unit 212 of the apparatus. A cast concrete lid 238 is provided for fitting over the open upper end of section 226 and is held in place by four screw threaded studs, two of which are indicated at 240 which are cast into section 226 so as to extend upwardly from the top end face of the section. The lid 238 is formed with openings to correspond with the three studs so that the lid can be fitted over the studs and secured in place by nuts and washers such as those indicated at 244. Four similar studs 242** are provided at the lower end of the section.

A steel air inlet tube 248 is fitted into an opening which extends through casting 226 at a position above the end face 236 of recess 232. Tube 48 is secured in place by a suitable epoxy adhesive. Casting 226 is also formed with suitable openings for the gas supply pipe 216 and for other necessary external connections (see later). All of these openings are air-tightly sealed with respect to ambient air.

The exhaust chamber casting 230 is also of generally cylindrical shape but includes an integral wall 250 at its lower end. At its upper end, section 230 is formed with a recess 252 generally similar to and of the same diameter as the recess 234 at the lower end of the air cushion chamber section 226. Four equally spaced screw-threaded studs, two of which are visible at 254 and 256 are cast into section 230 so as to extend vertically upwardly from the top edge of the section. Internally, section 230 is shaped to define a narrow annular shoulder 258 which supports a metal muffler plate 260. Plate 260 is secured in place using a suitable silicon sealer and divides the interior of section 230 into the muffler chamber 208 and the exhaust chamber 210. Plate 260 is made of steel and is fitted with a heat shield 262 and a muffler tube 264 generally similar to the structure described in connection with the first embodiment. An exhaust outlet pipe 266 extends through the wall of casting 230 below plate 260 and is secured in place by an epoxy adhesive. A condensate drain outlet 268 is similarly secured in an opening in the casting but below pipe 266.

The boiler section 228 of the inner casing of the heater is in the form of a cylindrical steel shell having an external diameter selected so that the shell can be fitted between the upper and lower casing sections 226 and 228 respectively with the respective ends of the shell received in the recesses 234 and 252 of the other two sections as shown. Beads of a suitable silicone sealer are introduced into the recesses before assembly to ensure gas-tight sealing. The casing sections are then assembled and clamped together in gas-tight fashion by means of the screw-threaded studs 242 and 254 which respectively project downwardly from section 226 and upwardly from section 230. Angle section brackets such as that indicated at 272 are welded to the external surface of shell 270 in positions to correspond with the positions of the studs 242 and 254. Each bracket has a limb, as limb 272*a*, which projects outwardly from the external surface of shell 270 and which is formed with an opening for receiving the relevant stud. Thus, the studs 242 and 254 project through the openings in the brackets and are fitted with suitable nuts and washers for clamping the shell 270 between the casing sections 226 and 230. A suitable silicon sealer is used to coat the bottom faces of the recess 234 and 252 to ensure gas-tight sealing.

Shell 270 forms part of a boiler sub-assembly of the heater and is provided at its upper and lower ends with respective boiler heads 274 and 276 which are welded inside the ends of the shell in accordance with conventional boiler manufacturing practice. Head 274 is formed with an opening 278 and the combustion chamber 218 is bolted to head 274 so as to protrude upwardly through opening 278. Thus, it will be noted that the combustion chamber includes an integral flange 218*a* which fits against the under surface of head 274 and by which the combustion chamber is bolted to the head. The exhaust system 220 of the heater will not be described in detail since it is essentially the same as the exhaust system previously described with reference to the first embodiment. For present purposes, it is sufficient to note that the exhaust system is disposed inside shell 270 and extends from the combustion chamber 218 to the bottom head 276. Suitable openings are provided in head 276 for receiving the lower end portions of the heat exchange coils of the exhaust system.

Shell 270 is also provided with internally screw-threaded water inlet and outlet couplings 280 and 282 which are located in openings in the shell and are welded in place. These couplings will receive external pipe work to be connected to the interior of the "boiler" represented by shell 270 and heads 274 and 276 for circulation of water around the combustion chamber and exhaust system. A third, similar coupling 284 is provided adjacent the lower end of shell 270 and is fitted with a plug 286 for clean out purposes.

It will be appreciated that the inner casing construction as described above has a significant advantage in that the air cushion chamber section 226 and the exhaust chamber section 230 are essentially isolated from one another by a sealed boiler section 228. As a sult, there is virtually no risk of leakage of exhaust gases from the muffler chamber 208 or the exhaust chamber 210 to the air cushion chamber 204. Additionally, this form of construction has the advantage that the heater can be constructed as three sub-assemblies which can be assembled individually and then bolted together as described. The assembly is then fitted into the outer casing 224 and the space between the two casings is filled with fiberglass insulation.

Figure 13:
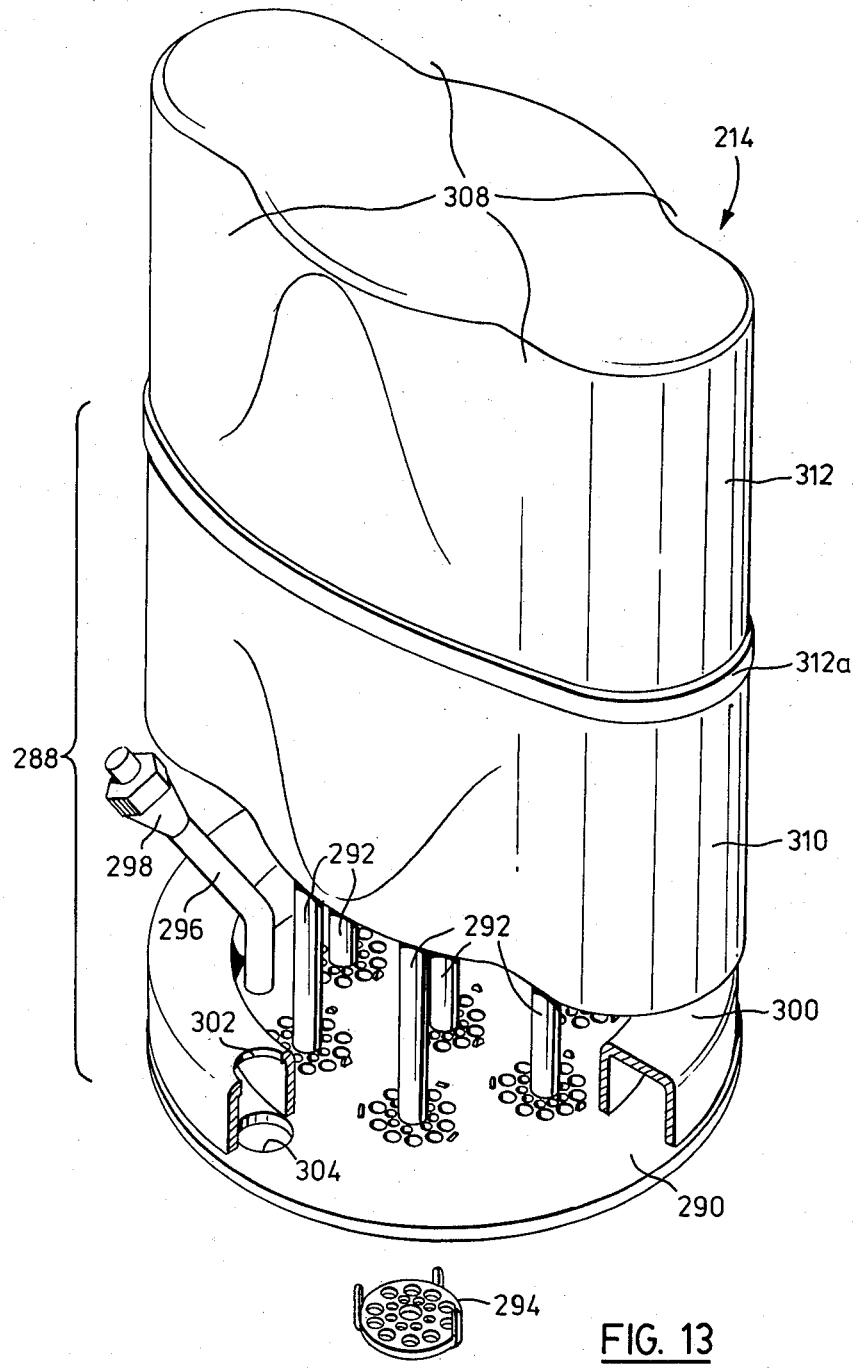
FIG. 13 is a perspective view of the gas cushion chamber of the apparatus shown in FIGS. 11 and 12; and, FIG. 14 is an exploded perspective view of the impeller assembly of the apparatus of FIGS. 11 and 12.

FIG. 13 illustrates the gas cushion sub-assembly of the heater, which is generally designated 288. This assembly includes cushion chamber 214 itself and the valve means associated with the combustion chamber 218. The valve means is essentially the same as that previously described with reference primarily to FIGS. 4 and 5 and will not therefore be described again in detail. It is sufficient to note that the valve means includes a valve plate 290 which is coupled to the gas cushion chamber 214 by a series of gas inlet tubes 292. The tubes 292 communicate with the interior of the gas cushion chamber 214 and with gas inlet openings in plate 290. At its lower end, each tube is surrounded by a series of air openings in plate 290 which allow air from the air cushion chamber 204 to enter the combustion chamber. Also associated with each series of openings is a valve comprising a valve retainer plate 294 and a valve disc (not shown) all as previously described with reference to FIGS. 4 and 5.

A pressure sensing tube 296 also extends upwardly from plate 290 and is fitted with coupling 298 at its outer end. Tube 296 communicates at its lower end with an opening in plate 290 which provides communication with the interior of the combustion chamber 218 when the gas cushion chamber sub-assembly in in place on the combustion chamber. Thus, by means of tube 296 a signal can be obtained as an indication of the pressure in the combustion chamber. This signal is used as an indication of whether or not combustion has been satisfactorily established in chamber 218.

When the gas cushion chamber sub-assembly is fitted to the combustion chamber, valve plate 290 is disposed on top of the chamber and is held in place by a clamping ring 300 which extends around the gas inlet tubes 292 above plate 290. Ring 300 is formed with four equally spaced openings 302 which match both with corresponding openings 304 in plate 290 and with four externally screw-threaded studs 306 which project upwardly from the top of combustion chamber 218. Thus, subassembly 288 is mounted on the combustion chamber by fitting the valve plate 290 and the clamping ring 300 over the studs 306 and fitting suitable nuts and washers to the studs. One of these nuts is indicated at 306 in FIG. 11 and the nuts associated with all four studs are similarly designated in FIG. 12. In order to provide for ease of access to the nuts 306 for fitting of subassembly 288 to the combustion chamber (and subsequent removal thereof if necessary) gas cushion chamber 214 is specially designed to provide recessed areas 308 in its external surface. Referring back to FIG. 13, the gas cushion chamber 214 is assembled from two substantially identical shell sections 310 and 312 which meet in a horizontal median plane of the chamber. Both sections are of oval shape in said plane and have side walls which are progressively shaped in moving away from said plane to define arcuate section troughs which the form the recesses 308 referred to above. As a result, the top wall of each shell has the general appearance of an oval which has been inwardly constricted at both sides of a center section. The upper shell 312 is formed around its lower margin with an outwardly stepped portion 312*a* which defines a recess receiving the upper marginal portion of the lower shell section 310.

The gas cushion chamber sub-assembly 288 has been designed so that its component parts can be assembled or stacked together generally in the positions in which they are shown in FIG. 13 and passed through a furnace brazing oven for brazing of the parts to one another. In this connection, it will be recalled that the valve disc retaining plates of the valve arrangement (as plates 294) are designed to be secured in place by brazing. The design of the gas cushion chamber sub-assembly also has the advantage that it can be bolted onto the combustion chamber of the heater as a unit. The design of the gas cushion chamber also allows ready access to the mounting studs 306 (FIG. 11) using a socket wrench as discussed previously.

Referring back to FIGS. 11 and 12, it will be remembered that gas is delivered to the gas cushion chamber 214 through a gas supply pipe 216 which extends through the wall of the air cushion chamber section 226 of the inner casing. Externally of both the inner and outer casing, pipe 266 is fitted with a gas pressure regulator 314 which has a control port 316 for receiving an air pressure signal by which the regulator 314 is biassed to vary the gas pressure delivered to the gas cushion chamber 214 according to the air pressure in chamber 226. This signal is provided by way of a pressure sensing tube 318 which extends from port 316 through the inner and outer casings 222 and 224 and which is secured in place by a suitable adhesive. Regulator 314 is designed to control the pressure of the gas supplied to chamber 214 in accordance with the air pressure in air cushion chamber 204 so as to maintain a substantially constant-/gas ratio. This has been found to be advantageous from the viewpoint of improving reliability of the heater.

Upstream of the gas pressure regulator 314, the gas supply line includes a solenoid operated gas valve for controlling delivery of gas to combustion chamber. The valve is a conventional on/off valve and has not been shown in detail.

The fan unit 212 of the heater is shown in an exploded position in FIG. 11. The unit includes an electric motor 320 and a shrouded impeller enclosed within a housing indicated at 322 in FIG. 11. The housing includes a peripheral flange 324 which rests on the bottom face 236 of the recess 232 in the air cushion chamber section 226 when the fan unit is in its installed position. A foam rubber gasket 326 is secured to flange 324 by adhesive for sealing with face 236. The impeller casing 322 includes an upwardly extending, central air inlet 328 and a helical compression spring 330 extends around inlet 328 and is dimensioned to fit between the portion of the impeller casing around the inlet and the underside of the lid 238 of the inner casing. Thus, when the fan unit is in its installed position, flange 324 rests on the end face 236 in recess 232 and the lid 238 is bolted onto the top of the air cushion chamber section 226. In this condition, spring 230 is under slight compressive loading and serves to urge the impeller casing 322 against face 236.

Figure 14:
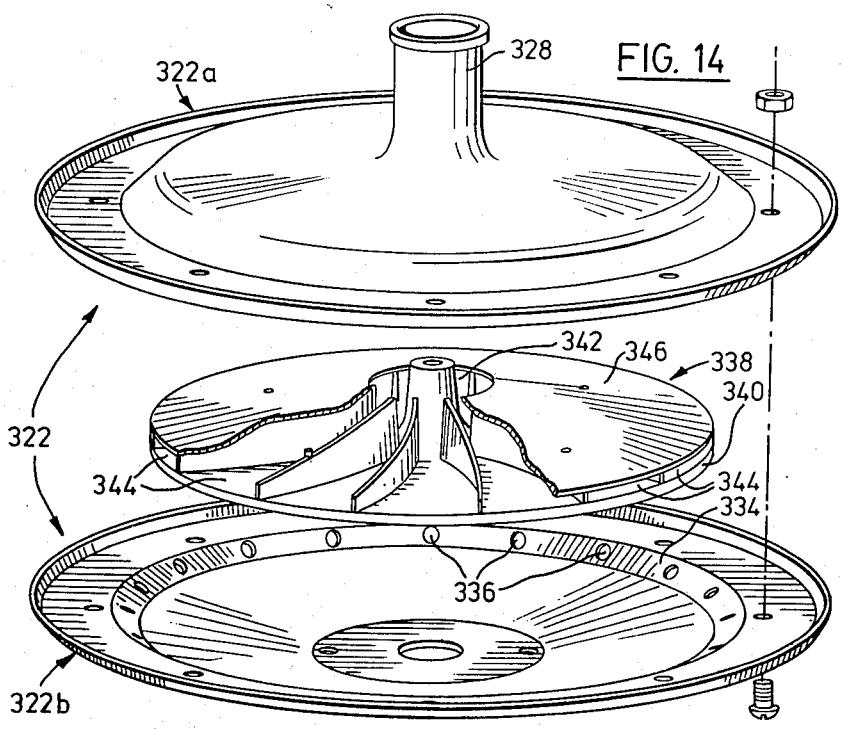

FIG. 14 is an exploded view of the impeller and housing. Housing 322 made in two parts, comprising an upper housing part 322*a* and a lower housing part 322*b*. The two parts have flattened peripheral portions which co-operate to define flange 324. Housing part 322*a* has the general shape of a shallow dome with a generally cylindrical upward extension as its center which defines air inlet 328. The lower housing part 322*b* is generally dish-shaped and includes a recessed central region 332 of circular shape surrounded by an annular wall 334. Wall 334 is formed with a series of circular air outlet openings 336. An impeller 338 is shown positioned between the two parts of the housing in FIG. 14. The impeller includes a disc-shaped main portion 340 surrounding a central boss 342 and having on its upper surface a plurality of arcuate shaped vanes 344 which radiate outwardly from boss 342. Boss 342 has a central bore which receives the drive shaft of motor 320 (not shown) and the boss is clamped to the drive shaft by a set screw (not shown).

A thin aluminum shroud 346 of slightly dished circular shape is fitted to the tops of the vanes 344 so that open ended air passageways are defined between the vanes. At their outer ends, the vanes extend above the main portion of 340 of the impeller so that the passageways are open at their outer ends. At their inner ends, the vanes 344 are cut away to define an air inlet region around boss 342. Shroud 346 is held in place by a number of relatively fine pins or studs which are formed on certain of the vanes which project through holes in the shroud and are peened over to hold the shroud in place.

The main portion 340 of the impeller is dimensioned to be accommodated within the recessed central portion 332 of lower housing part 322*b* so that the open outer ends of the air passageways defined between the vanes 344 discharge generally in the direction of the air outlet openings 336.

The form of impeller shown in FIG. 14 has been found to provide increased pressure output compared with a conventional impeller of comparable size. By way of example, a shrouded eight inch diameter impeller has been found eminently satisfactory for a heater of 100,000 btu output. A relatively high impeller output pressure has been found particularly desirable for ensuring reliable combustion cycle initiation where hot return water is present in the heat exchange chamber.

It should be noted that the preceeding description relates to specific embodiments of the invention only and that many modifications are possible within the broad scope of the claims. For example, the specific materials referred to herein are not to be considered as essential, but rather as indicating materials which have been found satisfactory in practice. Also, it should be noted that the apparatus described has been designed primarily for burning gaseous fuels such as natural gas or propane although the principles of the invention are applicable to an apparatus for burning other fuels, for example, fuel oil or coal dust. For this reason, the term "fuel charge" has been used to denote any appropriate combustion medium and is intended to include a gas-air mixture. Of course, where different fuels are used, different expedients would undoubtedly be required for delivering the fuel charge to the combustion chamber. Fuel delivery may be effected in the manner disclosed in my United States patent aforesaid.

With reference to the valve means specifically disclosed in this application, it is to be understood that the number of valves will vary according to the size, of the apparatus. Seven valves have been found appropriate to a 100,000 B.t.u. unit, but a larger number would be required for a larger apparatus.

Also, while the preceeding description relates specifically to a heater, it is to be noted that the invention is not limited in this regard. For example, a pulse combustion apparatus of the form provided by the invention could be used as an engine for the recovery of mechanical or electrical energy.

With reference to the exhaust system of the apparatus, it should be noted that the primary exhaust pipe could be omitted in some applications and heat exchange coil(s) connected directly to the combustion chamber (without a manifold). Of course the heat exchange pipes are also exhaust pipes whether or not a primary exhaust pipe (jet pipe) is present.

The primary exhaust pipe and/or the heat exchange coils may be internally coated with lead for corrosion protection and long life. The lead coating may be applied by conventional techniques to a suitable thickness. A small percentage of tin or other material may be included with the lead for improved adhesion.

What we claim as our invention is:

1. A pulse combustion heater comprising:

a housing which includes three housing sections of tubular form coupled together in a vertically stacked arrangement and comprising a top housing section defining an air cushion chamber, a center housing section defining a heat exchange chamber, and a bottom housing section defining an exhaust chamber, said top and bottom sections being in the form of concrete castings closed at their upper and lower ends respectively, and said center section forming part of a boiler sub-assembly further comprising top and bottom boiler heads closing opposite ends of said center housing section;

a combustion chamber disposed within said heat exchange chamber of the housing and having an inlet communicating with said air cushion chamber, and an outlet in said heat exchange chamber;

ignition means associated with said combustion chamber and operable to initiate combustion in said chamber; and, at least one exhaust pipe forming a resonant system with said combustion chamber, said exhaust pipe being disposed in said heat exchange chamber and communicating with the exterior of said housing.

2. A heater as claimed in claim 1, wherein each of said housing sections is of hollow cylindrical form, and wherein said top and bottom sections are formed with annular recesses in lower and upper ends thereof respectively, and wherein said center section is of a diameter such that its upper and lower ends fit into said recesses, the housing further including clamping means coupling said sections together and arranged to maintain gas-tight sealing between the sections.

3. A heater as claimed in claim 1, wherein said top section has a normally open upper end closed by a concrete lid which is removably clamped to said section so as to permit access to the air cushion chamber after removal of the lid.

4. A heater as claimed in claim 3, wherein said upper housing section is formed with an internal annular shoulder spaced downwardly from its upper end, and wherein the heater further comprises a fan unit disposed in said upper housing section and supported on said annular shoulder, and spring means acting between said lid and said fan unit for holding the unit in place, the fan unit defining an air inlet chamber at the top of the upper housing section, and the section further including an ambient air inlet to said air inlet chamber.

5. A heater as claimed in claim 1, wherein said bottom housing section is formed with an internal annular shoulder spaced downwardly from its upper end and supporting a partition member defining a muffler chamber above said member and said exhaust chamber below said member, said exhaust pipe discharging into said muffler chamber, and said partition member being formed with an opening permitting communication of exhaust gases between said muffler chamber and said exhaust chamber, and said bottom housing section including an exhaust gas outlet communicating with said exhaust chamber.

6. As pulse combustion apparatus comprising:

a housing defining an air cushion chamber;

a combustion chamber having an inlet communicating with said air cushion chamber, and an outlet;

a unitary gas cushion chamber sub-assembly disposed in said air cushion chamber and including: a hollow gas cushion chamber coupled to a supply of combustible gas; a valve plate extending across and closing said combustion chamber inlet; a plurality of gas inlet tubes extending upwardly from said valve plate and supporting said gas cushion chamber above said plate, each said tube communicating at its lower end with a gas inlet opening in said plate, and each such opening having associated therewith a plurality of air inlet openings communicating with said air cushion chamber; and a plurality of one-way valve disposed in said combustion chamber inlet and each including a corresponding plurality of valve members responsive to pressure in said combustion chamber and movable to close the gas and air inlet openings when combustion pressures exist in said chamber and to open said openings during a vacuum transient for admitting fuel;

ignition means operable to initiate combustion in said combustion chamber; and, at least one exhaust pipe forming a resonant system with said combustion chamber.

7. An apparatus as claimed in claim 6, wherein said gas cushion chamber sub-assembly is mounted on said combustion chamber by a clamping ring which extends around said gas inlet tubes above said valve plate and which is secured to the combustion chamber by a plurality of screw threaded clamping elements passing through said clamping ring and valve plate, whereby the valve plate is trapped between the clamping ring and combustion chamber.

8. An apparatus as claimed in claim 7, wherein said gas cushion chamber comprises two hollow shell halves coupled together in a horizontal median plane of the gas cushion chumber, and wherein said shell halves are externally contoured to facilitate access to said clamping elements from above for installation and removal of the gas cushion chamber sub-assembly.

9. An apparatus as claimed in claim 6, wherein each of said one-way valves comprises a valve member in the form of a light, pressure responsive disc disposed below said valve plate and movable to close the associated gas and air inlet openings in response to combustion pressure in said chamber, and to allow gas to enter said chamber during a vacuum transient therein, and a valve disc retaining member comprising a generally circular plate supporting said disc and formed with openings through which gas pressure in said combustion chamber can act on the disc, the retaining member being integrally formed with a series of spaced lugs which are coupled to the valve plate and are dimensioned to maintain the retaining plate at a predetermined spacing below the valve plate.

10. The invention of claim 1 or 6, wherein said exhaust pipe is internally coated with lead.

11. The invention of claim 1 or 6, wherein said exhaust pipe forms part of an exhaust system and defines a primary exhaust pipe having a first and second ends and coupled to the combustion chamber at its first end so as to extend generally tangentially from the combustion chamber, said primary exhaust pipe being of a length selected so that combustion of gases is at least substantially complete before the gases leave said pipe; and said exhaust system further including: a manifold having an inlet to which the second end of the primary exhaust pipe is coupled, and a plurality of outlets spaced around the manifold; and a corresponding plurality of heat exchange coils coupled to said manifold outlets.

12. The invention of claim 11, wherein each of said primary exhaust pipes and said heat exchange coils is internally coated with lead.

* * * * *